US005722505A

United States Patent [19]

Grabner et al.

[11] Patent Number: 5,722,505

[45] Date of Patent: Mar. 3, 1998

[54] MAN PLATFORM FOR AN AERIAL BOOM

[75] Inventors: David F. Grabner, Roanoke; Patrick M. DeLaney, Fort Wayne, both of Ind.

[73] Assignee: Teco, Inc., Fort Wayne, Ind.

[21] Appl. No.: 488,562

[22] Filed: Jun. 8, 1995

[51] Int. Cl.[6] ..... B66F 11/04

[52] U.S. Cl. ..... 182/2; 182/148; 182/63

[58] Field of Search ..... 182/2, 38, 63, 182/142, 148

[56] References Cited

U.S. PATENT DOCUMENTS

| | | | |
|---|---|---|---|
| 3,088,123 | 5/1963 | Loughridge | 182/148 X |
| 3,504,461 | 4/1970 | Copeland et al. | 182/2 X |
| 4,558,758 | 12/1985 | Littman et al. | 182/2 X |
| 4,640,383 | 2/1987 | Newberry | 182/2 X |
| 5,310,018 | 5/1994 | Lahaie | 182/148 X |
| 5,427,197 | 6/1995 | Waters | 182/2 |
| 5,460,246 | 10/1995 | Burch et al. | 182/2 X |

FOREIGN PATENT DOCUMENTS

| | | | |
|---|---|---|---|
| 645801 | 2/1979 | U.S.S.R. | 182/2 |

*Primary Examiner*—Peter M. Cuomo
*Assistant Examiner*—James O. Hansen
*Attorney, Agent, or Firm*—Lundy and Associates

[57] ABSTRACT

A man-lifting platform for mounting on an aerial boom comprising a frame adapted to be pivotally connected to the distal end of the aerial boom. The frame has a pair of sleeves on opposite sides thereof and a pair of rods in the sleeves. The rods are secured to the man-lifting platform and generally parallel fashion. A power cylinder is connected between the frame and the man-lifting platform whereby the man-lifting platform may be moved the length of the rods by actuation of the cylinder.

14 Claims, 2 Drawing Sheets

MAN PLATFORM FOR AN AERIAL BOOM

BACKGROUND OF THE INVENTION

This invention relates to aerial booms and more particularly to an improved man-lifting platform for an aerial boom which gives the man-lifting platform more maneuverability than in prior art aerial equipment.

Aerial equipment of articulated or extendible boom design have been adapted to raise and position one or more workmen in close proximity to elevated work to be performed. Articulated booms have been provided to increase the maneuverability of the man-lifting platform into a variety of positions. It has always been desirable to provide an improved aerial boom and man-lifting platform having increased maneuverability.

Man-lifting platforms have traditionally been pivotally connected to the distal end of aerial booms. Increased maneuverability between the man-lifting platform and the aerial boom has been generally by pivotal movement. Thus, it is highly desirable to provide an improved man-lifting platform for an aerial boom having increased maneuverability. It is also highly desirable to provide an improve man-lifting platform for an aerial boom having linear adjustability as well as pivotal adjustability.

Additionally, the weight carried by the aerial boom, especially with an over the center condition, causes a loss of maneuverability. Therefore it is highly desirable to provide improved maneuverability in a man-lifting platform on an aerial boom irrespective of the weight carried by the aerial boom.

It is also highly desirable to provide an improved aerial boom and man-lifting platform construction which gives the man-lifting platform additional maneuverability irrespective of the weight carried by the man-lifting platform which is simple in construction relatively inexpensive to manufacture and to maintain.

Finally it is highly desirable to provide an improved articulated boom and man-lifting platform having all of the above desired features.

SUMMARY OF THE INVENTION

It is therefore an object of the invention to provide an improved man-lifting platform for an aerial boom having increased maneuverability.

It is also an object of the invention to provide an improved man-lifting platform for an aerial boom having linear adjustability as well as pivotal adjustability.

It is also an object of the invention to provide improved maneuverability in a man-lifting platform on an aerial boom irrespective of the weight carried by the aerial boom.

It is also an object of the invention to provide an improved aerial boom and man-lifting platform construction which gives the man-lifting platform additional maneuverability irrespective of the weight carried by the man-lifting platform which is simple in construction relatively inexpensive to manufacture and to maintain.

It is finally an object of the invention to provide an improved articulated boom and man-lifting platform having all of the above desired features.

In the broader aspects of the invention there is provided a man-lifting platform for mounting on an aerial boom comprising a frame adapted to be pivotally connected to the distal end of the aerial boom. The frame has a pair of sleeves on opposite sides thereof and a pair of rods in the sleeves.

The rods are secured to the man-lifting platform and generally parallel fashion. A linear actuator is connected between the frame and the man-lifting platform whereby the man-lifting platform may be moved the length of the rods by actuation of the cylinder.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
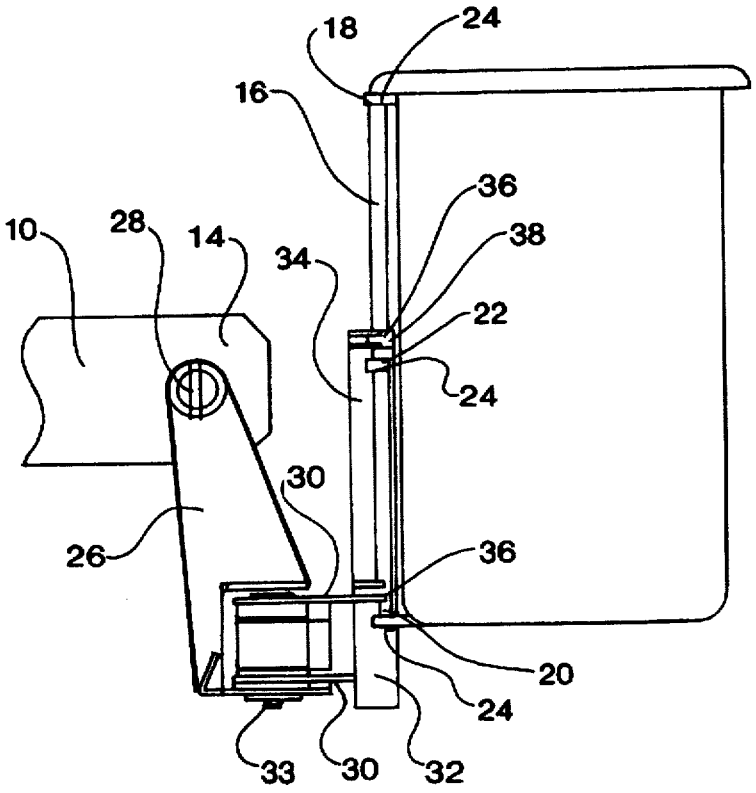
FIG. 1 is a fragmentary end elevational view of an aerial boom and the man-lifting platform of the invention in its highest position.
Figure 2:
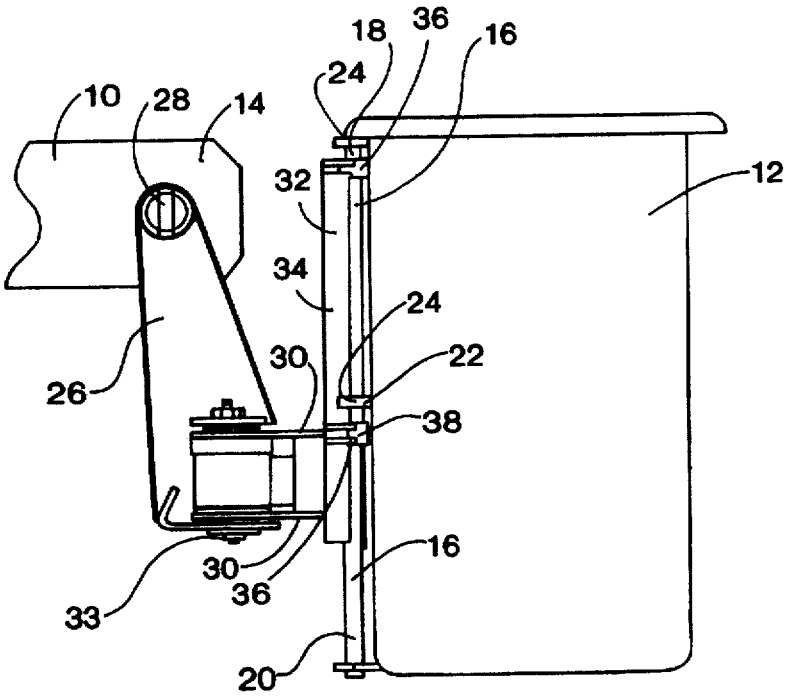
FIG. 2 is an end elevational view of the aerial boom and man-lifting platform shown in FIG. 1 in its lowest position.
Figure 3:
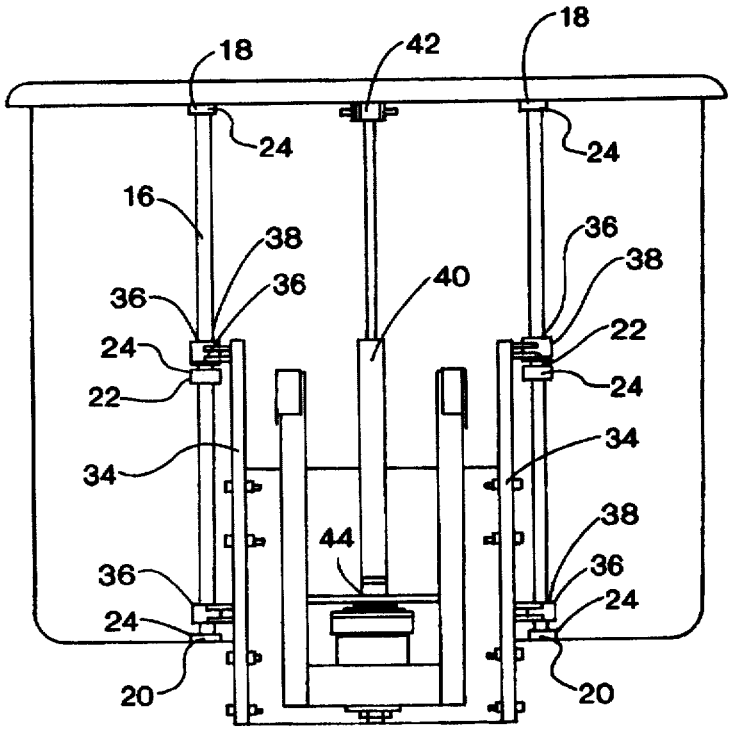
FIG. 3 is a rear side view showing the man-lifting platform in its highest position.

Referring to FIGS. 1–4, there is shown an aerial boom 10 and a man-lifting platform 12 of the invention operatively connected thereto or to the distal end 14 of aerial boom 10. Aerial boom 10 can be any of the aerial booms now available. Aerial boom 10 is provided as articulated boom and extendible booms. Both may be provided with the man-lifting platform 12 of the invention.

The man platform of the invention has secured to one side thereof a pair of rods 16. Rods 16 are spaced apart and generally parallel to each other. Rods 16 are secured to the man platform adjacent their opposite ends 18, 20 and adjacent their mid-point 22 by brackets 24. Rods 16 in FIGS. 1–4 are shown to extend generally vertically of the bottom of the man platform 12.

Two ears 26 are pivotally connected to the distal end 14 of the aerial boom 10 on opposite sides thereof. Ears 26 are spaced apart by the aerial boom 10 and are free to swing about the pivot 28. Similarly, a pair of ears 30 extend from a frame 32. Ears 30 are spaced apart and are secured to the frame so as to extend outwardly of the frame away from the man-lifting platform 12. Ears 30 are pivotally connected to the ears 26 about a pivot pin 33. Pivot pin 28 is generally horizontal as shown in FIGS. 1–4 and pivot pin 33 is generally vertical as shown in FIGS. 1–4.

Frame 32 is shown generally rectangular having upstanding beams 34 secured on opposite sides thereof to upstand therefrom. Beams 34 may extend beyond the upper boundary of frame 32 as shown. Beams 34 are generally parallel. Sleeves 36 extend from beams 34 to encompass rods 16. Sleeves 36 have bearings to provide for the smooth sliding of the sleeves over the rods 16 as will be described hereinafter.

Figure 4:
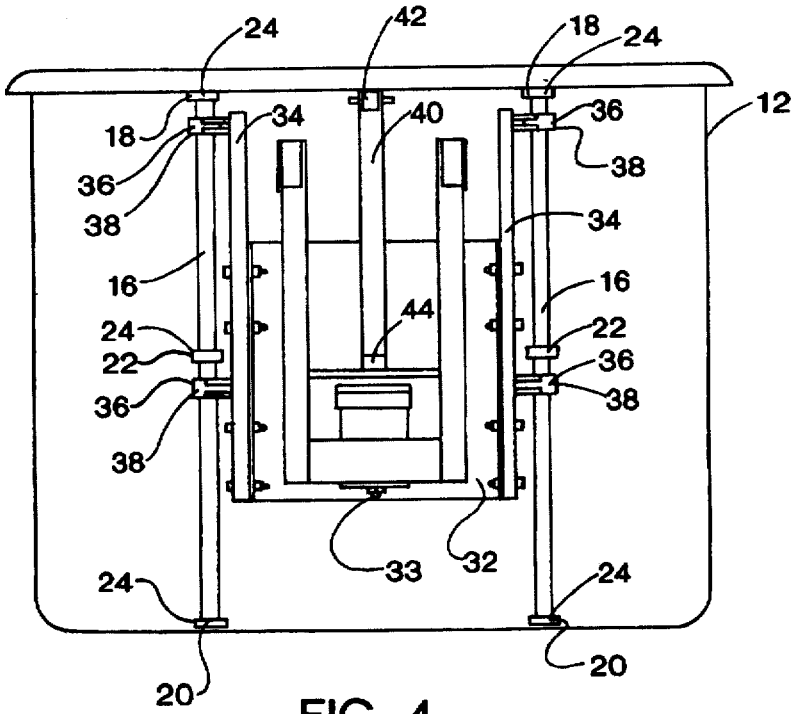
FIG. 4 is a view like FIG. 3 of the aerial boom and man-lifting platform of the invention in its lowest position.

A linear actuator 40 is secured between its opposite ends 42 and 44 to man-lifting platform 12 and frame 32, respectively. The actuator 40 is secured to frame 32 such that platform 12 is in its highest position when the actuator 40 is extended for reasons to be stated hereinafter. Thus, as shown in FIGS. 1–4, cylinder extends generally vertically and parallel to the rods 16 and the ears 26. Shown most closely in FIGS. 3 and 4, sleeves 36 when the man-lifting platform 12 is in its elevated position are adjacent to lower and median brackets 24, respectfully. As shown in FIG. 4 when the man-lifting platform is in its lowest position, sleeves 36 are adjacent to top and median brackets 24, respectfully. In the specific embodiment illustrated, actuator 40 is connected between spaced apart beams 34 to the frame adjacent the top ear 30.

In a specific embodiment, either pivot pin 28 or 33 may eliminated or both may be eliminated as desired. When both pivot pins 28 and 33 are eliminated, the sole movement between the man-lifting platform 12 and the aerial boom 10 is provided by the invention. In other specific embodiments, only pivot pin 28 or only pivot pin 33 and the invention is provided. In other specific embodiments, both pivot pins 28 and 33 and the invention are provided as shown in FIGS. 1–4.

Frame 32 is shown to be generally square in FIGS. 1–4. However, frame 32 could extend the full length of the beams 34 and thus be generally rectangular. In other specific embodiments, frame 32 could be other shapes as desired.

In the specific embodiment illustrated, frame 32, beams 34, ears 26 and 30 are each made of sheet steel. Rods 16 may be stainless steel and sleeves 36 may be of steel with the appropriate connections being made either by fasteners such as bolts and screws or by welding as desired. Both pivots pins 28 and 33 are provided by bolts extending through both ears and the aerial boom 10 as shown in FIGS. 1–4. The bearings 38 and the sleeves 36 in a specific embodiment may be ultra high molecular weight polyethylene bearings. The man-lifting platform may be conventional otherwise for the attached rods 16 and frame 32 and ears 26 and 30 as above described. In a specific embodiment, the actuator 40 may be a hydraulic or pneumatic cylinder or a screw actuator and the man-lifting platform may move half length of rods 16 from about 15 inches to about 20 inches.

In operation, the improved man-lifting platform 12 of the invention has new maneuverability. Man-lifting platform 12 may be kept horizontal as shown in FIGS. 1–4 or tilted as desired as the aerial boom 10 is raised by pivotally moving man platform 12 about pivot pin 28. The man-lifting platform 12 may be adjusted in a full arc about the distal end 14 of aerial boom 10 by movement of the man-lifting platform about pivot pin 33. Once in position, by actuating the actuator 40, man-lifting platform may be raised and held at any position between its lowest position illustrated in FIGS. 2 and 4 and its highest position illustrated in FIGS. 1 and 3. These movements, provide the improved man-lifting platform 12 of the invention with increased mobility never before obtained in man-lifting platforms on aerial booms.

The improved man-lifting platforms 12 for use on aerial booms 10 increases the maneuverability of the man-lifting platform 12 and allows a worker in the man-lifting platform 12 to exactly position the platform as desired. The improved man-lifting platform 12 of the invention has both pivotal and linear adjustability which is unaffected by the weight carried by aerial boom. The improved man-lifting platform 12 of the invention is relatively simple in construction and relatively inexpensive to both manufacture and to maintain.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A man platform mounted on an articulated aerial boom, said boom having a distal end, said man platform having a frame pivotally connected to said distal end of said aerial boom, said frame having a pair of sleeves, at least one rod in said sleeves, said rod being secured to said man platform, said rod being spaced from said platform, and a linear actuator connected between said frame and said platform, whereby said platform may be linearly moved relative to said aerial boom the length of said rod by actuation of said actuator.

2. The man platform of claim 1 wherein there are two spaced and parallel rods and four sleeves, and said sleeves are mounted adjacent the top and bottom of said frame, said frame is generally in the form of a parallel piped and said sleeves are mounted adjacent the corners of said frame.

3. A man platform mounted on an extendible aerial boom, said boom having a distal end, said man platform having a frame pivotally connected to said distal end of said aerial boom, said frame having a pair of sleeves, at least one rod in said sleeves, said rod being secured to said man platform, said rod being spaced from said platform, and a linear actuator connected between said frame and said platform, whereby said platform may be linearly moved relative to said aerial boom the length of said rod by actuation of said actuator.

4. The man platform of claim 3 wherein there are two spaced and parallel rods and four sleeves, and said sleeves are mounted adjacent to the top and bottom of said frame, said frame is generally in the from of a parallel piped and said sleeves are mounted adjacent the corners of said frame.

5. The man platform of claim 1 or 3 wherein said frame is pivotally connected to said aerial boom about a generally horizontal axis.

6. The man platform of claim 1 or 3 wherein said frame is pivotally connected to said aerial boom about a generally vertical axis.

7. The man platform of claim 1 or 3 wherein there are two spaced and parallel rods, said frame being generally rectangular and having two spaced top frame corners, and said sleeves are mounted adjacent to said top corners of said frame, respectively, said rods being in said sleeves, respectively.

8. The man platform of claim 1 or 3 wherein there are two spaced and parallel rods, said frame being generally rectangular and having two spaced bottom frame corners, and said sleeves are mounted adjacent to said bottom corners of said frame, respectively, said rods being in said sleeves, respectively.

9. The man platform of claim 1 or 3 wherein there are two spaced and parallel rods and four sleeves, said frame being generally rectangular and having spaced apart top frame corners and bottom frame corners, and said sleeves are mounted adjacent to said top and bottom corners of said frame, respectively, said rods being in a pair of said sleeves, respectively.

10. The man platform of claim 1 or 3 wherein said rod extends generally axially of said platform.

11. The man platform of claim 1 or 3 wherein said frame may move generally the height of said platform.

12. The man platform of claim 1 or 3 wherein said frame may move generally the height of said platform from about 15 inches to about 20 inches.

13. The man platform of claim 1 or 3 wherein said acutator is mounted between said rods.

14. The man platform of claim 1 or 3 wherein said frame has spaced apart arms between which said boom is positioned and said actuator is mounted.

* * * * *